US012392267B1

(12) United States Patent
Brazeel

(10) Patent No.: US 12,392,267 B1
(45) Date of Patent: Aug. 19, 2025

(54) OIL RESERVOIR FOR HIGH-PERFORMANCE ENGINE

(71) Applicant: Charles G. Brazeel, Fultondale, AL (US)

(72) Inventor: Charles G. Brazeel, Fultondale, AL (US)

( * ) Notice: Subject to any disclaimer, the term of this patent is extended or adjusted under 35 U.S.C. 154(b) by 0 days.

(21) Appl. No.: 19/084,990

(22) Filed: Mar. 20, 2025

(51) Int. Cl.
*F01M 11/00* (2006.01)

(52) U.S. Cl.
CPC . *F01M 11/0004* (2013.01); *F01M 2011/0041* (2013.01); *F01M 2011/005* (2013.01); *F01M 2011/007* (2013.01)

(58) Field of Classification Search
CPC ..... F01M 11/0004; F01M 11/062; F01M 11/064; F01M 11/065; F01M 2011/0041; F01M 2011/005; F01M 2011/007
See application file for complete search history.

(56) References Cited

U.S. PATENT DOCUMENTS 2,022,898 A * 12/1935 Niven ..... F16N 9/04 184/6.2
2,938,601 A * 5/1960 Brafford ..... F01M 11/065 184/6.2
3,500,750 A * 3/1970 Vohl ..... F04B 53/1037 222/376
6,260,534 B1 * 7/2001 Kampichler ..... F01M 11/03 123/196 R
10,006,324 B2 * 6/2018 Youm ..... F01M 11/0004
10,495,120 B2 * 12/2019 Fisher ..... F16H 61/0025
2003/0042078 A1 * 3/2003 Baeumler ..... F01M 11/02 184/6.23
2004/0231924 A1 * 11/2004 Schwarzl ..... F01M 11/0004 184/6.23
2010/0108019 A1 * 5/2010 Klumpp ..... F01M 11/064 123/196 R
2016/0333752 A1 * 11/2016 Aldridge ..... F01M 11/064

OTHER PUBLICATIONS

Excerpts from Rennlist online technical discussion forum entitled "Ultimate Integrated Dry Sump UIDS v2.2" (see https://rennlist.com/forums/996-forum/1260027-ultimate-integrated-dry-sump-uids-v2-2-a.html). Forum thread started Jul. 13, 2021. The 2 excerpts are from p. 59 (posted Apr. 16, 2023) and p. 61 (posted Jun. 6, 2023), the excerpts showing prior versions of the Oil Reservoir for High-Performance Engine posted by the inventor Charles Brazeel under his username "Porschetech3".

* cited by examiner

*Primary Examiner* — Minh Truong
(74) *Attorney, Agent, or Firm* — AdamsIP, LLC; Kenneth Bush

(57) ABSTRACT

A lubrication fluid reservoir apparatus for a vehicle engine is disclosed herein. The apparatus includes a sump plate having a tunnel port assembly, a valve assembly, and a baffle assembly that are operable to minimize agitation of lubrication fluid in the sump plate and maintain lubrication fluid available to a lubrication fluid take-up tube during high G-force turns of the vehicle to prevent engine oil starvation, in various aspects.

3 Claims, 5 Drawing Sheets

OIL RESERVOIR FOR HIGH-PERFORMANCE ENGINE

FIELD OF THE INVENTION

The present application relates to an oil reservoir apparatus for a high-performance vehicle engine that prevents engine oil starvation.

BACKGROUND OF THE INVENTION

High-performance vehicle engines may include an oil sump located at the base of the engine for storing oil. An oil pump draws oil from the oil sump via a take-up tube and delivers the oil to the engine to lubricate the engine parts. The oil is then drained or pumped back into the oil sump for reuse.

During high G-force turns of these high-performance vehicles, the oil will tend to flow towards the sides of the oil sump, which can move oil away from the take-up tube and thereby prevent oil from being pumped into the engine, a condition known as engine oil starvation. This is very undesirable because it reduces engine performance and can result in damage to the engine parts.

Various improvements have been made to these oil sump systems to maintain oil around the take-up tube during high G-force turns to prevent engine oil starvation with varying degrees of success, but the problem still persists. Accordingly, there is a need for an improved oil reservoir apparatus for a high-performance engine that prevents engine oil starvation.

BRIEF SUMMARY OF THE INVENTION

These and other needs and disadvantages may be overcome by the apparatus and methods disclosed herein. Additional improvements and advantages may be recognized by those of ordinary skill in the art upon study of the present disclosure.

In various aspects, a lubrication fluid reservoir apparatus for a vehicle engine is disclosed herein. The apparatus includes a sump plate adapted for attachment to the base of the vehicle engine, in various aspects. Tunnel ports are formed along the sump plate floor, in various aspects. A first tunnel port has a first opening at a first side of the sump plate and a second opening at a central area of the sump plate, in various aspects. A second tunnel port has a first opening at a second side of the sump plate and a second opening at the central area of the sump plate, in various aspects.

A valve body is mounted above the first tunnel port second opening and the second tunnel port second opening, wherein the valve body has a first chamber in fluid communication with the first tunnel port second opening, a second chamber in fluid communication with the second tunnel port second opening, a central chamber in fluid communication with the first and second chambers, and a top opening in communication with the central chamber for receiving a lubrication fluid take-up tube, in various aspects. The lubrication fluid take-up tube is adapted to withdraw lubrication fluid from the valve body central chamber through the valve body top opening for delivery to the engine for lubrication purposes, in various aspects.

A valve shaft is slidably mounted within the valve body, wherein the valve shaft has a first end extending out of a first side of the valve body and a second end extending out of a second side of the valve body, in various aspects. A first weighted roller is mounted to the valve shaft first end and a second weighted roller is mounted to the valve shaft second end, wherein the first and second weighted rollers are adapted to move the valve shaft within the valve body in response to G-force acting upon the first and second weighted rollers, in various aspects. At least one fin is attached to the valve shaft, external of the valve body, wherein the fin is adapted to move the valve shaft within the valve body in response to lubrication fluid pushing against the fin in response to G-force acting upon the lubrication fluid, in various aspects.

A first baffle is mounted between the first tunnel port first opening and the valve body, wherein the first baffle is adapted to maintain lubrication fluid at the first tunnel port first opening, in various aspects. A first deaerator hood is mounted to the first baffle and extends towards the sump plate first side, wherein the first deaerator hood is adapted to prevent agitation of lubrication fluid in the area between the first baffle and the sump plate first side, in various aspects. A second baffle is mounted between the second tunnel port first opening and the valve body, wherein the second baffle is adapted to maintain lubrication fluid at the second tunnel port first opening, in various aspects. A second deaerator hood is mounted to the second baffle and extends towards the sump plate second side, wherein the second deaerator hood is adapted to prevent agitation of lubrication fluid in the area between the second baffle and the sump plate second side, in various aspects.

The valve shaft is operable to slide between a first open position and a second open position, in various aspects. The first tunnel port first opening is in fluid communication with the central chamber through the first chamber when the valve shaft is in the first open position and the second tunnel port first opening is blocked from fluid communication with the central chamber through the second chamber when the valve shaft is in the first open position, in various aspects. The second tunnel port first opening is in fluid communication with the central chamber through the second chamber when the valve shaft is in the second open position and the first tunnel port first opening is blocked from fluid communication with the central chamber through the first chamber when the valve shaft is in the second open position, in various aspects.

The lubrication fluid reservoir apparatus is operable to maintain lubrication fluid, such as lubrication oil, adjacent the tunnel port first openings during high G-force turns of the vehicle. This ensures that lubrication fluid is always available to be drawn up by the lubrication fluid take-up tube via the valve body and thus prevents engine oil starvation. In addition, the baffles with attached deaerator hoods are operable to minimize agitation of the lubrication fluid in the sump plate to help prevent air from becoming entrapped within the lubrication fluid and being drawn up into the engine, thus optimizing engine performance.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

The Figures are exemplary only, and the exemplary implementations illustrated therein are selected to facilitate explanation. For example, the components of various apparatus illustrated in the Figures may be selected for explanatory purposes, and the components may be grouped in the Figures in various ways to facilitate description, so that the apparatus may include various other components or the components may be grouped in various other ways, in other implementations. The number, position, relationship and dimensions of the elements shown in the Figures to form the various implementations described herein are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the Figures and are utilized to facilitate description thereof. Use herein of relative terms such as generally, about, approximately, essentially, may be indicative of engineering, manufacturing, computational, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

Figure 1:
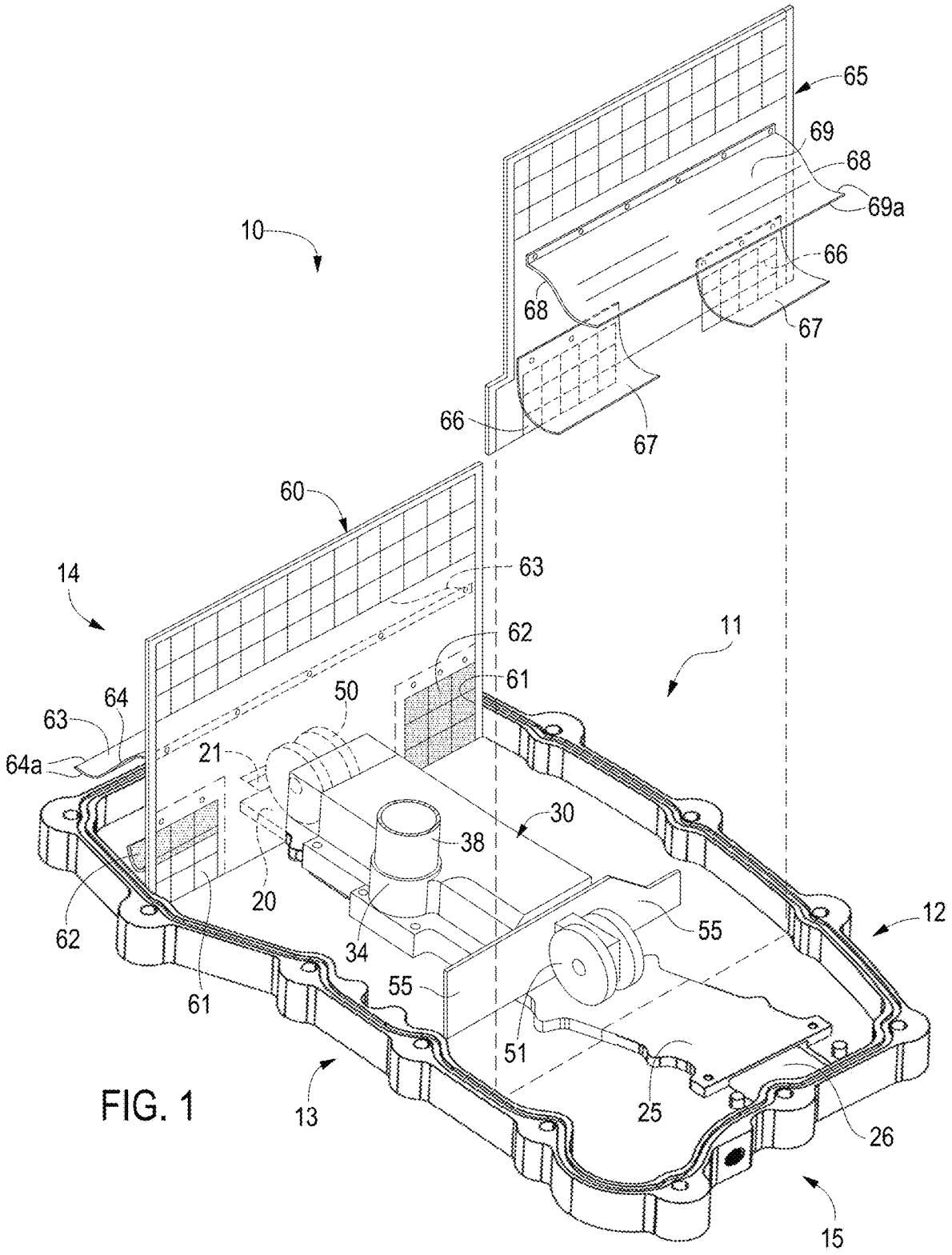
FIG. 1 illustrates by partially exploded top perspective view an exemplary lubrication fluid reservoir apparatus.
Figure 2:
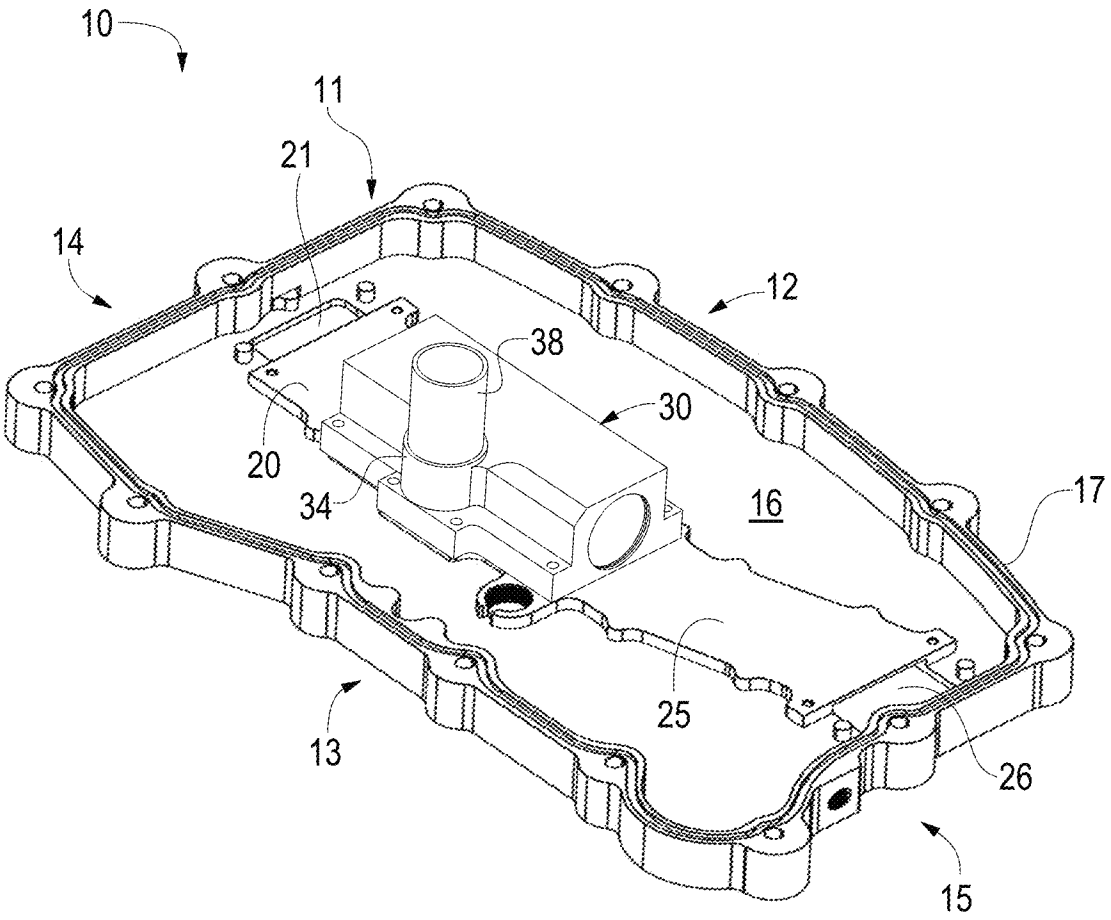
FIG. 2 illustrates by top perspective view a portion of the lubrication fluid reservoir apparatus shown in FIG. 1.
Figure 4:
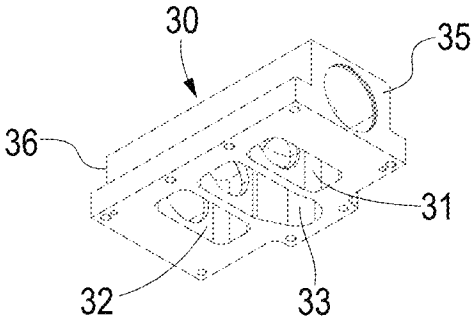
FIG. 4 illustrates by bottom perspective view a portion of the lubrication fluid reservoir apparatus shown in FIG. 1.
Figure 3:
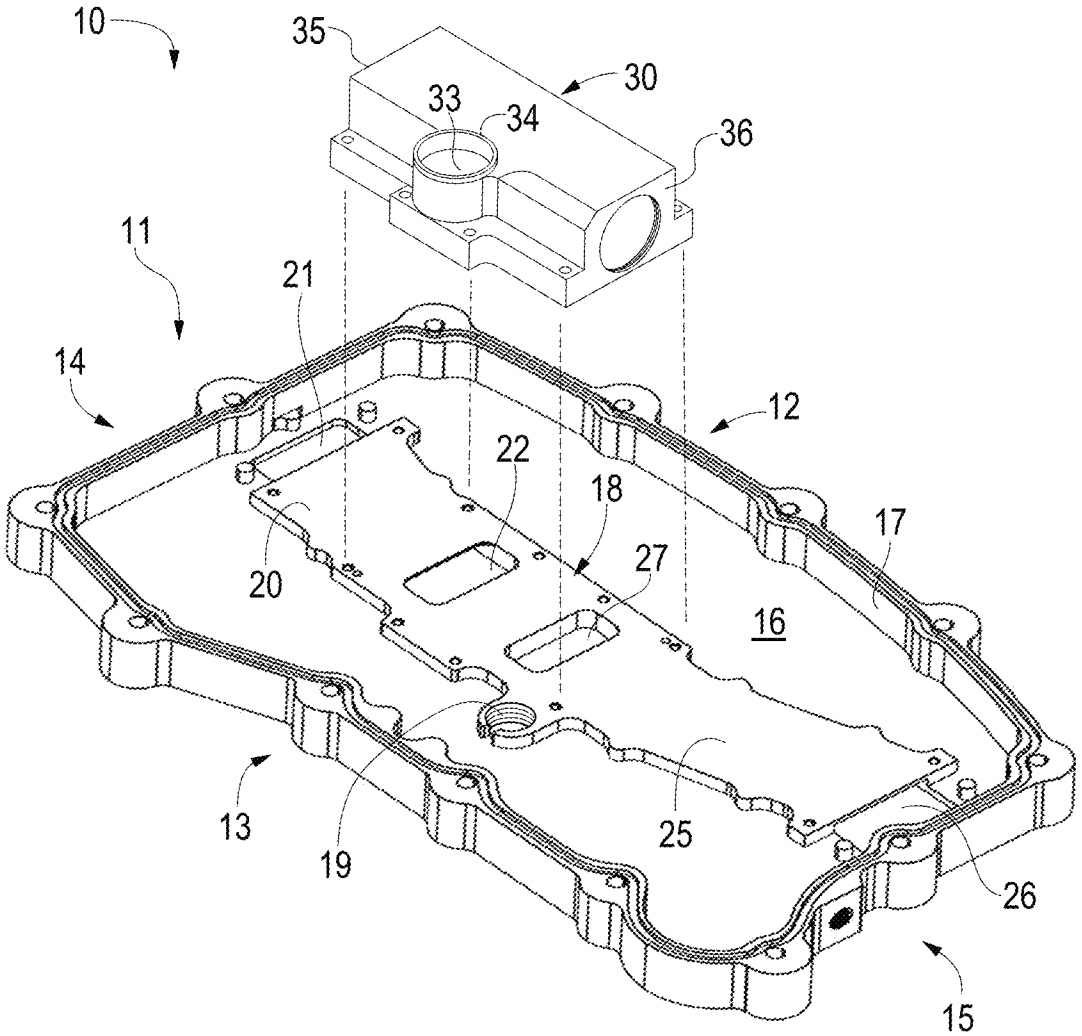
FIG. 3 illustrates by partially exploded top perspective view a portion of the lubrication fluid reservoir apparatus shown in FIG. 1.
Figure 5:
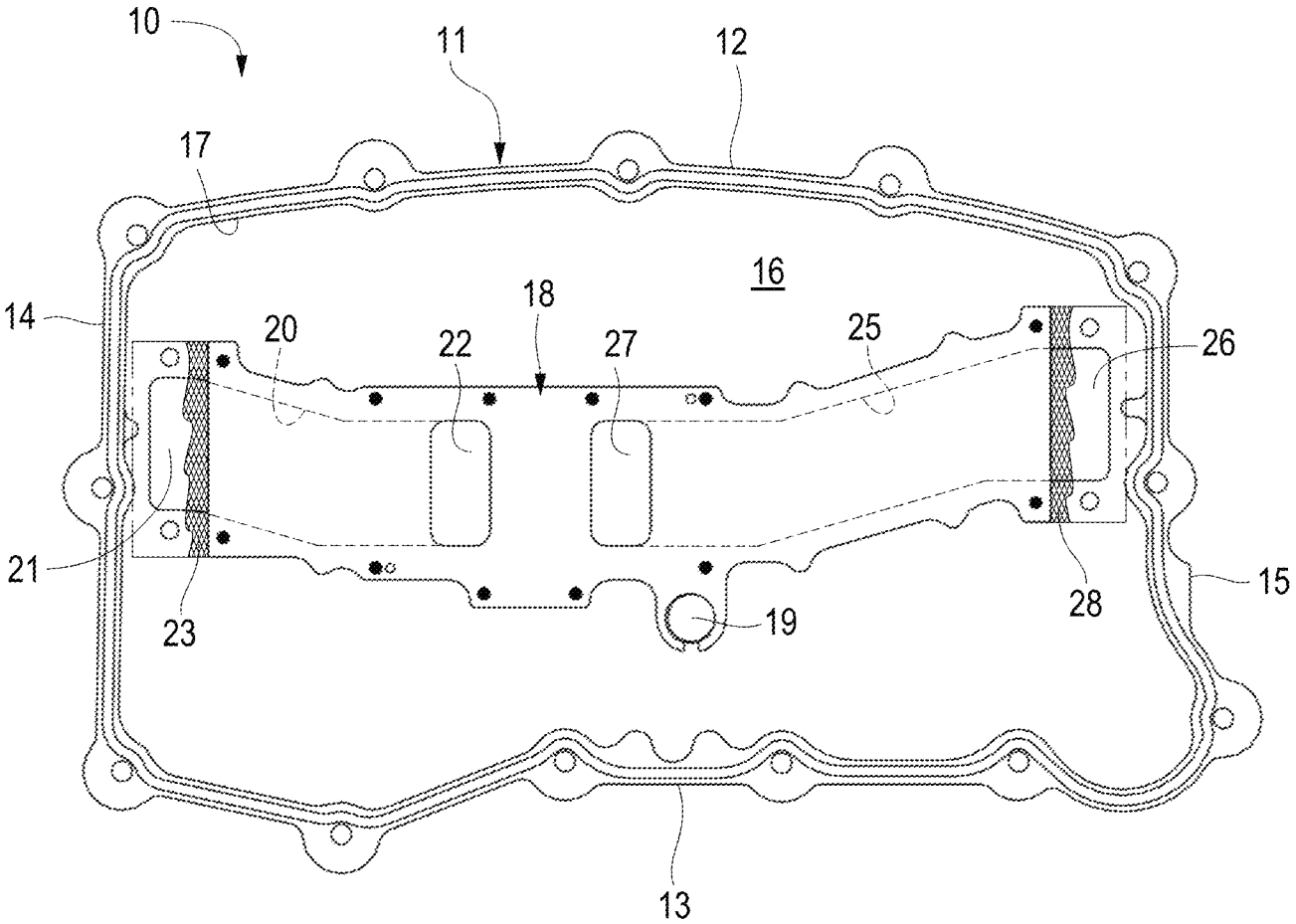
FIG. 5 illustrates by top plan view a portion of the lubrication fluid reservoir apparatus shown in FIG. 1.
Figure 6:
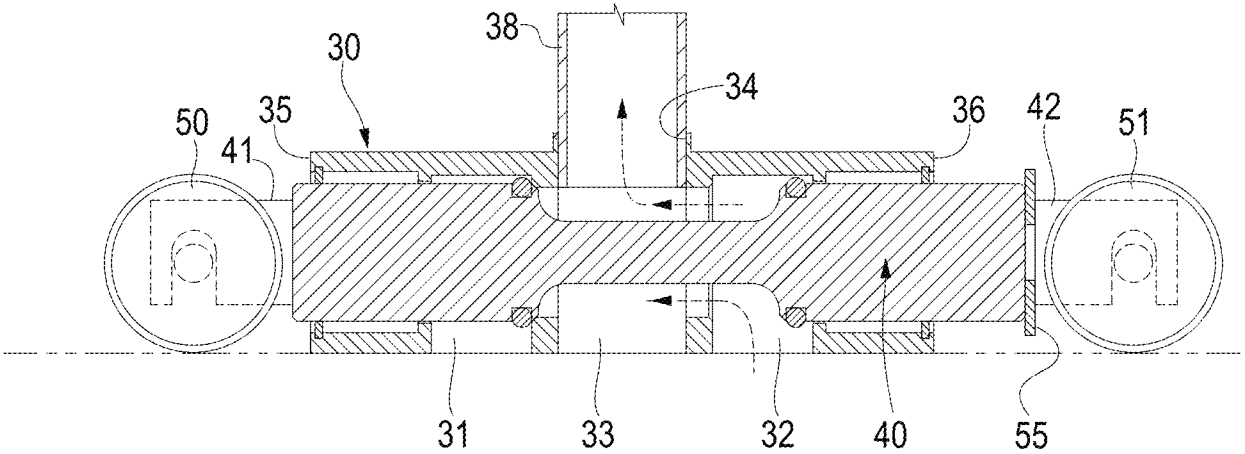
FIG. 6 illustrates by sectional view a portion of the lubrication fluid reservoir apparatus shown in FIG. 1.
Figure 7:
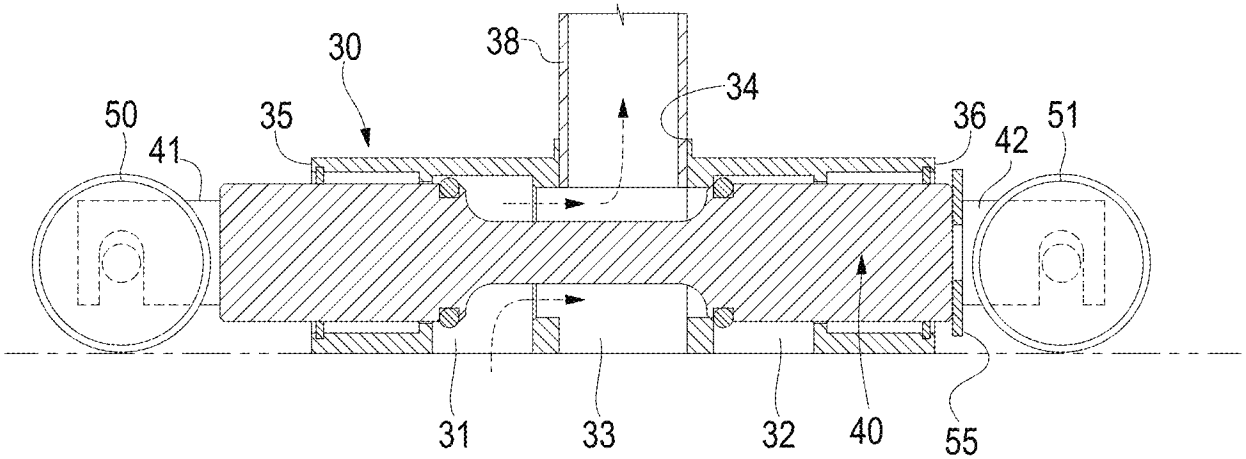
FIG. 7 illustrates by sectional view a portion of the lubrication fluid reservoir apparatus shown in FIG. 1.

In various aspects, a lubrication fluid reservoir apparatus 10 for a vehicle engine is disclosed herein. The apparatus 10, illustrated in FIGS. 1-7, comprises a substantially rectangular sump plate 11 adapted for attachment to the base of the vehicle engine (not shown), the sump plate 11 having a front end 12 and an opposing rear end 13, a first side 14 and an opposing second side 15, a floor 16, a perimeter wall 17, and a central area 18, the sump plate 11 adapted to store lubrication fluid (not shown). A drain hole 19 allows the lubrication fluid to be drained from the sump plate 11.

A first tunnel port 20 is formed along the sump plate floor 16, the first tunnel port 20 having a first opening 21 at the first side 14 of the sump plate 11 and a second opening 22 at the central area 18 of the sump plate 11, wherein the first tunnel port first and second openings 21, 22 are in fluid communication with each other through the first tunnel port 20. A size exclusion screen 23 preferably covers the first tunnel port first opening 21 to prevent larger particulate matter from entering the first tunnel port 20.

A second tunnel port 25 is formed along the sump plate floor 16, the second tunnel port 25 having a first opening 26 at the second side 15 of the sump plate 11 and a second opening 27 at the central area 18 of the sump plate 11, wherein the second tunnel port first and second openings 26, 27 are in fluid communication with each other through the second tunnel port 25. A size exclusion screen 28 preferably covers the second tunnel port first opening 26 to prevent larger particulate matter from entering the second tunnel port 25.

A valve body 30 is mounted above the first tunnel port second opening 22 and the second tunnel port second opening 27, the valve body 30 having a first chamber 31 in fluid communication with the first tunnel port second opening 22, a second chamber 32 in fluid communication with the second tunnel port second opening 27, and a central chamber 33 in fluid communication with the first and second chambers 31, 32, the valve body 30 having a top opening 34 in communication with the central chamber 33 for receiving a lubrication fluid take-up tube 38. The lubrication fluid take-up tube 38 is adapted to withdraw lubrication fluid from the valve body central chamber 33 through the valve body top opening 34. A valve shaft 40 is slidably mounted within the valve body 30, the valve shaft 40 having a first end 41 extending out of a first side 35 of the valve body 30 and a second end 42 extending out of a second side 36 of the valve body 30.

At least one first weighted roller 50 is mounted to the valve shaft first end 41 and at least one second weighted roller 51 is mounted to the valve shaft second end 42, wherein the first and second weighted rollers 50, 51 are adapted to move the valve shaft 40 within the valve body 30 in response to G-force acting upon the first and second weighted rollers 50, 51. A fin 55 is attached to the valve shaft 40 external of the valve body 34, wherein the fin 55 is adapted to move the valve shaft 40 within the valve body 30 in response to lubrication fluid pushing against the fin 55. The fin 55 may be attached to the valve shaft first end 41 or second end 42. Additional fins may be attached to the valve shaft first and/or second end 41, 42.

A first baffle 60 is mounted between the first tunnel port first opening 21 and the valve body 30, the first baffle 60 having at least one opening 61 covered by a one-way flap 62, the first baffle 60 adapted to reduce agitation of lubrication fluid in the area between the first baffle 60 and the sump plate first side 14 and maintain lubrication fluid at the first tunnel port first opening 21. A first deaerator hood 63 is mounted to the first baffle 60 and extends towards the sump plate first side 14. The first deaerator hood 63 has a downwardly sloped upper surface 64 that provides an impact surface for lubrication fluid returning to the sump plate 11 from the vehicle engine. The returning lubrication fluid lands on the upper surface 64 and runs to the edges 64*a* of the upper surface 64 and into the sump plate first side 14. This prevents the returning lubrication fluid from splashing into lubrication fluid in the sump plate 11 and introducing bubbles into the lubrication fluid. In addition, the first deaerator hood 63 is adapted to engage the upper surface of the lubrication fluid and thereby prevent the lubrication fluid from sloshing around or swirling within the sump plate first side 14 and thus preventing air from entering the first tunnel port first opening 21.

A second baffle 65 is mounted between the second tunnel port first opening 26 and the valve body 30, the second baffle 65 having at least one opening 66 covered by a one-way flap 67, the second baffle 65 adapted to reduce agitation of lubrication fluid in the area between the second baffle 65 and the sump plate second side 15 and maintain lubrication fluid at the second tunnel port first opening 26. A second deaerator hood 68 is mounted to the second baffle 65 and extends towards the sump plate second side 15. The second deaerator hood 68 has a downwardly sloped upper surface 69 that provides an impact surface for lubrication fluid returning to the sump plate 11 from the vehicle engine. The returning lubrication fluid lands on the upper surface 69 and runs to the edges 69*a* of the upper surface 69 and into the sump plate second side 15. This prevents the returning lubrication fluid from splashing into lubrication fluid in the sump plate 11 and introducing bubbles into the lubrication fluid. In addition, the second deaerator hood 68 is adapted to engage the upper surface of the lubrication fluid and thereby prevent the lubrication fluid from sloshing around or swirling within the sump plate second side 15 and thus preventing air from entering the second tunnel port first opening 26.

The valve shaft 40 is operable to slide between a first open position and a second open position. The first tunnel port first opening 21 is in fluid communication with the central chamber 33 through the first chamber 31 when the valve shaft 40 is in the first open position, shown in FIG. 7, wherein the second tunnel port first opening 26 is blocked from fluid communication with the central chamber 33 through the second chamber 32 when the valve shaft 40 is in the first open position. The second tunnel port first opening 26 is in fluid communication with the central chamber 33 through the second chamber 32 when the valve shaft 40 is in the second open position, shown in FIG. 6, wherein the first tunnel port first opening 21 is blocked from fluid communication with the central chamber 33 through the first chamber 31 when the valve shaft 40 is in the second open position.

The lubrication fluid reservoir apparatus 10 is operable to maintain lubrication fluid, such as lubrication oil, adjacent the tunnel port first openings 21, 26 during high G-force turns of the vehicle. This ensures that lubrication fluid is always available to be drawn up by the lubrication fluid take-up tube 38 via the valve body 30 and thus prevents engine oil starvation. In addition, the baffles 60, 65 with attached deaerator hoods 63, 68 are operable to minimize agitation of the lubrication fluid in the sump plate 11 to help prevent air from becoming entrapped within the lubrication fluid and being drawn up into the engine, thus optimizing engine performance.

The foregoing discussion along with the Figures disclose and describe various exemplary implementations. These implementations are not meant to limit the scope of coverage, but, instead, to assist in understanding the context of the language used in this specification and in the claims. The Abstract is presented to meet requirements of 40 C.F.R. § 1.72(b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A lubrication fluid reservoir apparatus for a vehicle engine, comprising:

a. a substantially rectangular sump plate adapted for attachment to a base of the vehicle engine, the sump plate having a front end and an opposing rear end, a first side and an opposing second side, a floor, and a perimeter wall, the sump plate adapted to store lubrication fluid;

b. a first tunnel port formed along the sump plate floor, the first tunnel port having a first opening at the first side of the sump plate and a second opening at a central area of the sump plate, wherein the first tunnel port first and second openings are in fluid communication with each other through the first tunnel port;

c. a second tunnel port formed along the sump plate floor, the second tunnel port having a first opening at the second side of the sump plate and a second opening at the central area of the sump plate, wherein the second tunnel port first and second openings are in fluid communication with each other through the second tunnel port;

d. a valve body mounted above the first tunnel port second opening and the second tunnel port second opening, the valve body having a first chamber in fluid communication with the first tunnel port second opening, a second chamber in fluid communication with the second tunnel port second opening, a central chamber in fluid communication with the first and second chambers, and a top opening in communication with the central chamber for receiving a lubrication fluid take-up tube;

e. a valve shaft slidably mounted within the valve body, the valve shaft having a first end extending out of a first side of the valve body and a second end extending out of a second side of the valve body;

f. a first weighted roller mounted to the valve shaft first end and a second weighted roller mounted to the valve shaft second end, wherein the first and second weighted rollers are adapted to move the valve shaft within the valve body in response to G-force acting upon the first and second weighted rollers;

g. a fin attached to the valve shaft external of the valve body, wherein the fin is adapted to move the valve shaft within the valve body in response to lubrication fluid pushing against the fin in response to G-force acting upon the lubrication fluid;

h. a first baffle mounted between the first tunnel port first opening and the valve body, the first baffle having at least one opening covered by a one-way flap, the first baffle adapted to maintain lubrication fluid at the first tunnel port first opening;

i. a first deaerator hood mounted across a substantial portion of the first baffle and comprising a downwardly sloped upper surface extending towards the sump plate first side, the first deaerator hood adapted to prevent agitation of lubrication a fluid in area between the first baffle and the sump plate first side;

j. a second baffle mounted between the second tunnel port first opening and the valve body, the second baffle having at least one opening covered by a one-way flap, the second baffle adapted to maintain lubrication fluid at the second tunnel port first opening; and k. a second deaerator hood mounted to the second baffle and extending towards the sump plate second side, the second deaerator hood adapted to prevent agitation of a lubrication fluid in area between the second baffle and the sump plate second side;

l. wherein the valve shaft is operable to slide between a first open position and a second open position, wherein the first tunnel port first opening is in fluid communication with the central chamber through the first chamber when the valve shaft is in the first open position, wherein the second tunnel port first opening is blocked from fluid communication with the central chamber through the second chamber when the valve shaft is in the first open position, wherein the second tunnel port first opening is in fluid communication with the central chamber through the second chamber when the valve shaft is in the second open position, wherein the first tunnel port first opening is blocked from fluid communication with the central chamber through the first chamber when the valve shaft is in the second open position;

m. wherein the lubrication fluid take-up tube is adapted to withdraw lubrication fluid from the valve body central chamber through the valve body top opening.

2. A lubrication fluid reservoir apparatus for a vehicle engine, comprising:

a. a sump plate adapted for attachment to a base of the vehicle engine, the sump plate having a front end and an opposing rear end, a first side and an opposing second side, a floor, and a perimeter wall, the sump plate adapted to store lubrication fluid;

b. a first tunnel port formed along the sump plate floor, the first tunnel port having a first opening at the first side of the sump plate and a second opening at a central area of the sump plate, wherein the first tunnel port first and second openings are in fluid communication with each other through the first tunnel port;

c. a second tunnel port formed along the sump plate floor, the second tunnel port having a first opening at the second side of the sump plate and a second opening at the central area of the sump plate, wherein the second tunnel port first and second openings are in fluid communication with each other through the second tunnel port;

d. a valve body mounted above the first tunnel port second opening and the second tunnel port second opening, the valve body having a central chamber in fluid communication with the first tunnel port second opening and the second tunnel port second opening, the valve body having a top opening in communication with the central chamber for receiving a lubrication fluid take-up tube;

e. a valve shaft slidably mounted within the valve body, the valve shaft having a first end extending out of a first side of the valve body and a second end extending out of a second side of the valve body;

f. a fin attached to the valve shaft external of the valve body, wherein the fin is adapted to move the valve shaft within the valve body in response to lubrication fluid pushing against the fin in response to G-force acting upon the lubrication fluid;

g. a first baffle mounted between the first tunnel port first opening and the valve body, the first baffle having at least one opening covered by a one-way flap, the first baffle adapted to maintain lubrication fluid at the first tunnel port first opening;

h. a first deaerator hood mounted across a substantial portion of the first baffle and comprising a downwardly sloped upper surface extending towards the sump plate first side, the first deaerator hood adapted to prevent agitation of lubrication a fluid in area between the first baffle and the sump plate first side;

i. a second baffle mounted between the second tunnel port first opening and the valve body, the second baffle having at least one opening covered by a one-way flap, the second baffle adapted to maintain lubrication fluid at the second tunnel port first opening; and j. a second deaerator hood mounted to the second baffle and extending towards the sump plate second side, the second deaerator hood adapted to prevent agitation of a lubrication fluid in area between the second baffle and the sump plate second side;

k. wherein the valve shaft is operable to slide between a first open position and a second open position, wherein the first tunnel port first opening is in fluid communication with the central chamber when the valve shaft is in the first open position, wherein the second tunnel port first opening is blocked from fluid communication with the central chamber when the valve shaft is in the first open position, wherein the second tunnel port first opening is in fluid communication with the central chamber when the valve shaft is in the second open position, wherein the first tunnel port first opening is blocked from fluid communication with the central chamber when the valve shaft is in the second open position;

l. wherein the lubrication fluid take-up tube is adapted to withdraw lubrication fluid from the valve body central chamber through the valve body top opening.

3. The apparatus according to claim 2, further comprising a first weighted roller mounted to the valve shaft first end and a second weighted roller mounted to the valve shaft second end, wherein the first and second weighted rollers are adapted to move the valve shaft within the valve body in response to G-force acting upon the first and second weighted rollers.

* * * * *